US006371207B1

(12) United States Patent
Reynolds

(10) Patent No.: US 6,371,207 B1
(45) Date of Patent: Apr. 16, 2002

(54) METHOD AND APPARATUS FOR DISPLACING DRILLING FLUIDS WITH COMPLETION AND WORKOVER FLUIDS, AND FOR CLEANING TUBULAR MEMBERS

(75) Inventor: J. Scott Reynolds, Houston, TX (US)

(73) Assignee: M-I L.L.C., Houston, TX (US)

( * ) Notice: Subject to any disclaimer, the term of this patent is extended or adjusted under 35 U.S.C. 154(b) by 0 days.

(21) Appl. No.: 09/329,544

(22) Filed: Jun. 10, 1999

(51) Int. Cl.[7] ..... E21B 37/02; E21B 37/10

(52) U.S. Cl. ..... 166/312; 166/185; 166/195; 166/202; 166/153; 166/173

(58) Field of Search ..... 166/311, 312, 166/185, 191, 192, 195, 196, 202, 153, 156, 170, 173, 171

(56) References Cited

U.S. PATENT DOCUMENTS

| | | | | | |
|---|---|---|---|---|---|
| 2,362,198 | A | * | 11/1944 | Gibson | |
| 2,652,120 | A | * | 9/1953 | Hodges | 166/149 |
| 2,687,774 | A | * | 8/1954 | Hodges | 166/312 |
| 2,825,411 | A | * | 3/1958 | Keltner | 166/177.7 |
| 3,169,580 | A | * | 2/1965 | Bateman | |
| 3,637,010 | A | * | 1/1972 | Maly et al. | 166/51 |
| 4,064,941 | A | * | 12/1977 | Smith | 166/300 |
| 4,671,355 | A | * | 6/1987 | Strange | |
| 4,838,354 | A | * | 6/1989 | Jenkins | 166/311 |
| 4,892,145 | A | * | 1/1990 | Stafford | |
| 4,921,046 | A | * | 5/1990 | Caskey | 166/170 |
| 5,076,365 | A | * | 12/1991 | Jenkins | 166/311 |
| 5,119,874 | A | * | 6/1992 | Ferguson et al. | 166/105.2 |

* cited by examiner

*Primary Examiner*—Roger Schoeppel
(74) *Attorney, Agent, or Firm*—The Matthews Firm

(57) ABSTRACT

A tubular body or mandrel incorporated into a string of tubular pipe, on which first and second swab cups and a casing scraper are mounted, is run into a cased earth borehole to displace a first fluid in the borehole, usually a drilling fluid, with a second fluid, usually either a completion fluid or a workover fluid. In a first embodiment, reverse circulation, in which the second fluid is pumped into the borehole annulus above the swab cups, and in which the first fluid is thereby pumped back towards the earth's surface through the interior of the string of tubular pipe, causes displacement of the first fluid merely by lowering the string of pipe while pumping the second fluid into the borehole annulus. In a second embodiment, using normal circulation, the first fluid is pumped from the earth's surface downwardly through the interior of the string of tubular pipe into the borehole annulus between the pair of swab cups. The first fluid is then displaced from the preselected zone of the cased borehole by raising or lowering the string of tubular pipe. In an alternative embodiment, the tubular pipe, upon which the swab cups and casing scrapers are mounted, is pulled out of the riser or cased borehole to displace the undesired fluid in the riser or cased borehole. In yet another embodiment, a plurality of large swab cups are shearingly secured to the tubular body and a plurality of smaller swab cups are secured to the tubular body, which also includes one or more spring-loaded casing scrapers mounted below the smaller swab cups, thereby allowing the apparatus to be used in progressively smaller diameter casing during the same operation of the apparatus.

19 Claims, 11 Drawing Sheets

METHOD AND APPARATUS FOR DISPLACING DRILLING FLUIDS WITH COMPLETION AND WORKOVER FLUIDS, AND FOR CLEANING TUBULAR MEMBERS

FIELD OF THE INVENTION

The invention relates, generally, to new and improved methods and apparatus using mechanical separation between the drilling fluid and the displacement fluids, and specifically, to the use of swab cups to mechanically separate the drilling fluid from the displacement fluids, in combination with a casing scraper to remove debris from the inner wall of the casing or other tubular members. The method and apparatus can also be used to clean up downhole fluids, and can be used to wipe well casing and completion risers clean, even with varying internal diameters.

BACKGROUND OF THE INVENTION

It is well known in the art of the completion and/or the workover of oil and gas wells to displace the drilling fluid with a completion fluid or a workover fluid. A workover fluid will typically be either a surface cleaning fluid, such as an acid, to clean out the perforations in the casing, or a formation treating chemical which can be used with proppants to prop open the formation. The completion fluid will typically be a clear, heavy brine such as calcium chloride, calcium bromide or zinc bromide, or various combinations of such heavy brines. The density of such clear brines is generally selected and controlled to ensure that the hydrostatic head or pressure of the fluid in the wellbore will match the hydrostatic pressure of the column of drilling fluid being displaced.

Displacement "spacers", as they are commonly named, are used between the drilling fluid and the completion fluid, and these are typically formulated from specific chemicals designed for the specific base drilling fluid being displaced, and will typically include weighted or unweighted barrier spacers, viscous barrier spacers, flocculating spacers, and casing cleaning chemicals, as desired.

It is well known in this art that complete displacement of the drilling fluids is critical to the success of completion and/or workover operations. It is extremely important that the brines not be mixed with the drilling fluid itself.

In the prior art, there are two principal displacement methods, viz., direct and indirect. The choice between direct and indirect has depended upon casing-tubing strengths, cement bond log results, and exposure of the formation of interest. If the cement bond logs and the casing strength data indicate that the casing would withstand a calculated pressure differential, ie., that the casing would not rupture, and that the formation of interest is not exposed, the conventional technique has been that of indirect displacement.

In a typical indirect displacement, large volumes of sea water are used to flush the drilling fluid out of the well. When applying the flushing method, however, it is very important that the pressure of the salt water flush not exceed the pressure which would burst the casing being flushed.

Direct displacement of the drilling fluid, used by those in this art whenever there are pressure problems or the formation of interest is exposed, uses chemical agents and weighted fluids to clean the wellbore and to separate the drilling fluid from the workover/completion fluid. Because a constant hydrostatic pressure is maintained, pressure problems are eliminated. Direct displacement is normally used when (1) casing and tubulars cannot withstand the pressures associated with the indirect displacement procedure; (2) when the formation of interest is exposed; (3) if a source of flushing water, typically salt water, is not readily available; or (4) in the event of disposal and discharge restraints being imposed on the particular well or group of wells.

A common element to both the direct and indirect displacement procedures is the use of barriers and cleaning chemicals ("spacers") for effective hole cleaning and separation between the drilling fluid and the completion/workover fluid. The primary purpose of a barrier spacer is to provide a complete separation between the drilling fluid and the completion/workover fluid. In such prior art systems, the spacer fluid must be compatible with both the drilling fluid and the workover/completion fluid.

However, to the best of applicant's knowledge, the prior art has not had the ability to displace the drilling fluid with a workover/completion fluid without using a spacer fluid between the drilling fluid and the workover/completion fluid.

It is also well known in this art to use casing scrapers to clean-off the interior wall of a downhole casing, but typically, cannot use the same tool in cleaning casing strings or other tubular members of varying diameters. The following prior art United States patents show various combinations of casing scrapers and/or swab cups, but none of such patents, taken alone or in combination, show or suggest the combination of the present invention.

PRIOR ART

Gibson 2,362,198: This shows a casing scraper (brush) in combination with swab cups 17 in FIG. 1, and the flow of various fluids (water, circulation fluid or cement) through the hollow rod 10. This device is meant to vertically reciprocate to clean the interior of casing, but does not suggest using the swab cups as a mechanical separation of the drilling fluid and the completion fluid.

Hodges 2,652,120: This shows a casing scraper 22 and a seal ring 23 (an inflatable packer instead of a swab cup) and a reciprocating rod 15 to create a suction which cleans out the perforations 12 in the casing (see Col. 3, lines 48–68 concerning its operation). The patent does not suggest the concept of mechanical separation of the fluids.

Hodges 2,687,774: This is related to Hodges 2,652,120, discussed above, and is of no additional relevance.

Keltner 2,825,411: This shows a swabbing device which includes a typical chemical cleaning process in conjunction with the reciprocating swabbing process. (See Col. 6, lines 1–11 for the chemical cleaning process.) There is no suggestion of mechanically separating the completion fluid from the drilling fluid.

Maly, et al., 3,637,010: This is of very little, if any, relevance, showing packers 66 and 68 (see FIG. 2) in a gravel packing operation in horizontal wells.

Jenkins 4,838,354: This shows a casing scraper with blades 18 and a packer 76 supported by a tubing string 12 having a drill bit 48 at its lower end, all within the casing 68. The production packer 76 is apparently anchored to the casing wall independently of the downward movement of the tubing string 12. This patent does not suggest the concept involving the mechanical separation of the fluids. In fact, as the pumped fluid exits the drill bit, the fluid returns back through the annulus 82 between the tubing string 12 and the inner tubular member 66 passing through the interior of the packer 76.

Stafford 4,892,145: This shows chevron packings 22 and 23, on opposite sides of a cavity "AC" (see FIG. 2). Knife blade 34 functions as a scraper between the chevron packings 22 and 23. Once the chevron packings have isolated the perforations in the casing, fluid is pumped out of openings 27 in the mandrel 11 to clean out the perforations.

Caskey 4,921,046: This shows a cleanup tool for cleaning the interior of a casing string having a packer cup 18 for sealing the tool to the casing wall, and which pumps clean out fluid out through the port 84 into the casing below the packer cup. The debris is then picked up by the pumped fluid and pumped into the lower end of the mandrel 70 and pumped back to the earth's surface. This does not suggest a mechanical separation of the completion fluid and the drilling fluid.

Jenkins 5,076,365: This is the same disclosure as 4,838,354, discussed above, and the same comments apply.

Ferguson et al. 5,119,874: This well clean out system is used to pump sand and other debris out of the bottom of a producing well, but aside from using swab cups, has essentially no relevance to the present invention.

OBJECTS OF THE INVENTION

It is therefore the primary object of the present invention to provide new and improved methods and apparatus for displacing the drilling fluid in a wellbore with one or more completion and/or workover fluids.

It is yet another object of the present invention to provide a new and improved cleaning and/or wiping of the interior of drilling and completion risers.

It is another object of the present invention to provide new and improved separation of the drilling fluid from one or more completion and/or workover fluids.

It is another object of the invention to provide new and improved methods and apparatus for cleaning the interior surfaces of casing strings or other tubular members having progressively smaller internal diameters as a function of depth of the casing in earth boreholes.

SUMMARY OF THE INVENTION

The present invention is directed, generally, to methods and apparatus which employ a plurality of swab cups integrally located within a string of tubular pipe, positioned within a cased earth borehole, or within a drilling or completion riser, and having drilling fluid located on one side of the plurality of swab cups and the workover fluid or the completion fluid located on the other side of the plurality of swab cups, resulting in a mechanical separation of the drilling fluid and the workover/completion fluid.

In one mode of the invention, the tubular is lowered into the cased wellbore, typically loaded with drilling fluid, with the completion/workover fluid being pumped behind the plurality of swab cups. This action forces the drilling fluid to be pumped from the wellbore through the interior of the tubular back near or to the earth's surface.

As an additional feature of the invention, a mechanical scraper is run below the swab cups to help clean the interior of the well casing and to prevent or lessen any damage to the swab cups.

In an alternative embodiment of the invention, the displacement fluid is located between a pair of swab cups and the drilling fluid located in the borehole annulus other than between the pair of swab cups.

Alternatively, the combination swab cup and scraper assembly is run to the desired depth in the cased wellbore, or riser, and then pulled out of the hole, bringing the drilling fluid or other fluid to be displaced towards the earth's surface by taking returns up the annulus, with that portion of the cased borehole, or the riser, below the assembly being back-filled with the displacement fluid.

As a special feature of the invention, the tool includes swab cups of varying external diameters, in which at least one or more of them are sheared upon meeting decreased diameter tubulars, allowing the tool to be used in varying diameter tubulars.

DETAILED DESCRIPTION OF THE PREFERRED EMBODIMENT

Figure 1:
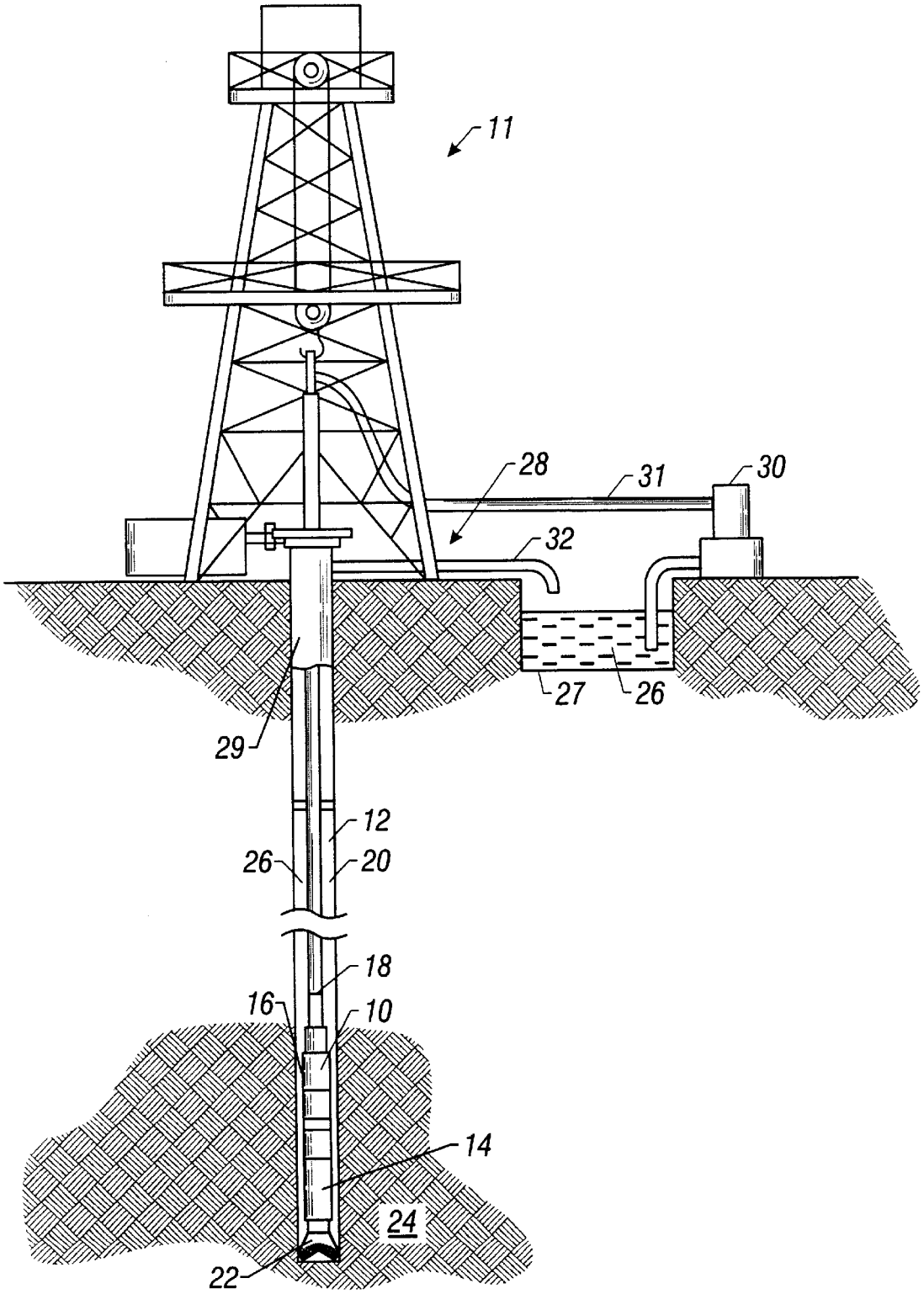
FIG. 1 is an elevated, side pictorial view, partly in cross-section, illustrating a drilling rig using normal circulation of the drilling fluid through the drillstring.

Referring now specifically to the drawings, and first to FIG. 1, there is shown a drilling rig 11 disposed atop a borehole 12. An MWD instrument 10, commonly used to provide measurements while drilling, but which are not required for the present invention, is carried by a sub 14, typically a drill collar, incorporated into a drill string 18 and disposed within the borehole 12. A drill bit 22 is located at the lower end of the drill string 18 and carves a borehole 12 through the earth formations 24. Drilling mud 26 is pumped from a storage reservoir pit 27 near the wellhead 28, down an axial passageway (not shown) through the drill string 18, out of apertures in the bit 22 and back to the surface through the annular region 16, usually referred to as the annulus. Metal surface casing 29 is positioned in the borehole 12 above the drill bit 22 for maintaining the integrity of the upper portion of the borehole 12.

In the operation of the apparatus illustrated in FIG. 1, in which the drilling fluid is pumped down through the interior of the drill string 18, out through the bit 22, and back to the earth's surface via the annulus 16, there is thus described so-called "normal circulation".

In a method commonly used in the prior art, still referring to FIG. 1, the drill string 18 is pulled out of the borehole, and the drill bit 22 removed from the end of the drill string. A string of steel casing is run into the well at least down to the formation which is believed to contain oil and/or gas. At this point in time, the cased borehole will typically still contain some volume of drilling fluid. The drill string 18 is then run back into the wellbore until its lower end is below the formation of interest. A spacer fluid, discussed above as usually including various chemicals for cleaning the interior of the casing, is pumped down the interior of the drill string, theoretically causing the drilling fluid to be displaced and pumped toward the earth's surface through the annulus 16. The completion or workover fluid is then pumped down the interior of the drill string 18, displacing the spacer fluid, and causing the spacer fluid to be pumped towards the earth's surface, all as is conventional and well known in this art. This, of course, can be problematic in that the three (3) fluids, ie., the drilling fluid, the spacer fluid and the completion fluid often times tend to mix, rather than continue as three discrete, separated fluids.

Figure 2:
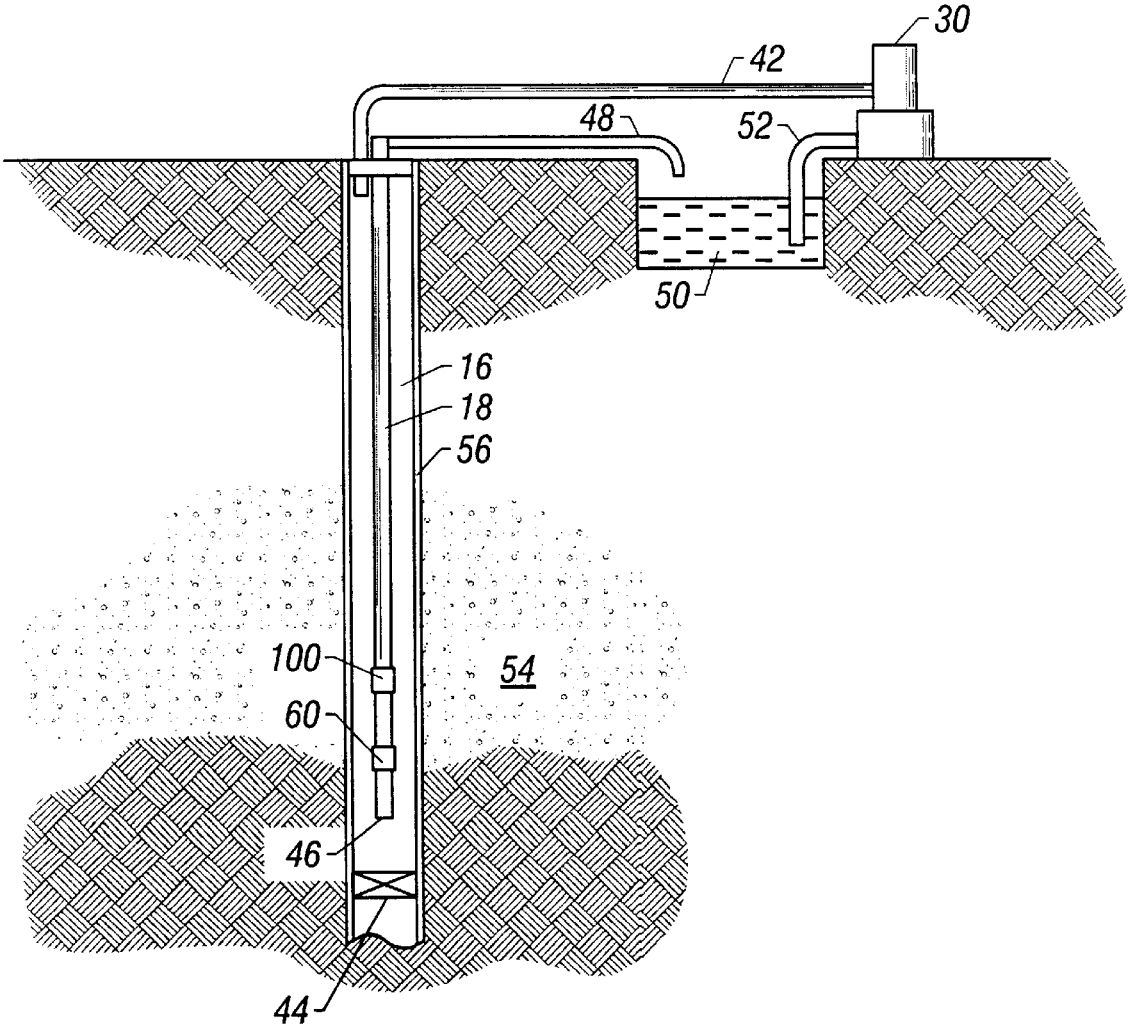
FIG. 2 is an elevated, side, diagrammatic view of a rig site using reverse circulation of the drilling fluid through the drillstring.

In the "reverse circulation" mode of operation, illustrated diagrammatically in FIG. 2, the mud pump 30 is connected such that its output pumps mud (drilling fluid) into and along the annulus 16 and then into the lower end of the drill string 18, and ultimately back to the earth's surface, all of which is well recognized and understood by those skilled in the art of drilling oil and gas wells.

In FIG. 2, in the reverse circulation mode, the mud pump 30 has its output connected through a line 42 into the annulus 16. If desired, a packer 44 is set below the open end 46 of the drill string 18 to isolate the portion of the wellbore above the packer from the portion of the wellbore below the packer. The interior of the drill string 18 is connected through a fluid line 48 back to the mud tank 50. The fluid line 52, connected into the mud tank 50, is connected to the fluid input of mud pump 30.

It should be appreciated that most drilling operations use the normal circulation system embodied in FIG. 1, although some wells have been drilled using the reverse circulation mode of FIG. 2, in which the drilling fluid is pumped down the annulus 16, through the drill bit (not illustrated in FIG. 2) and up through the interior of the drill string 18 back to the mud pit 49 containing the drilling fluid 50.

Referring further to FIG. 2, once it has been determined from well logs, earth core samples and the like, that a potential oil and/or gas zone has been identified at a given depth in the formation, for example, the zone 54, steel casing 56 is positioned in the wellbore, and the process begins for displacing the drilling fluid with completion fluid, typically a clear, heavy brine as above discussed. Once the interior of the casing string has been cleaned, and the completion fluid is in place, the casing can be perforated by explosive charges, for example, with bullets or shaped charges, all of which are conventional and well known in this art, and the oil and/or gas in the producing zone, if any, can be produced through the perforations into the wellbore and pumped to the earth's surface through conventional means, for example, through production tubing.

In providing the displacement fluids, if done in the conventional mode, the drilling fluid in mud tank 49 is cleaned out and replaced by a spacer fluid, above discussed and usually containing chemical cleaning fluids. After the spacer is pumped in, the spacer fluid is cleaned out of the mud pit 49 and replaced with the completion fluid, which is then pumped in to displace the spacer fluid.

Figure 3:
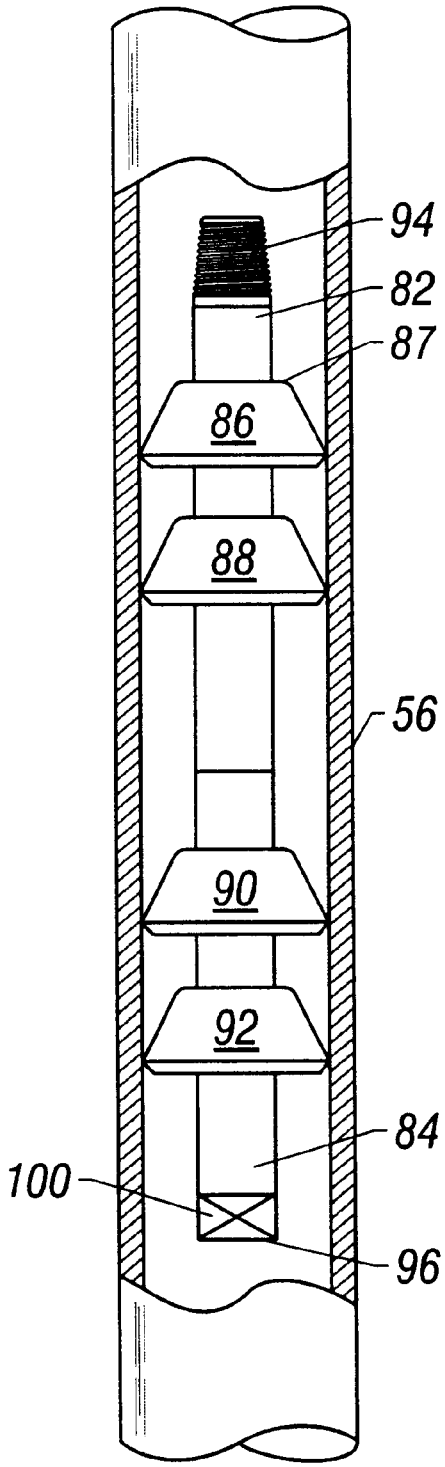
FIG. 3 is an elevated, side, diagrammatic view of the combined well swab and casing scraper used in accordance with the present invention.

Referring now to FIG. 3, a sub 80 is incorporated into the drill string 18 in accordance with the present invention. The sub 80 is actually a pair of subs 82 and 84 which together substitute for the drill collar 60 illustrated in FIG. 2. Sub 82 has a pair of conventional, elastomeric swab cups 86 and 88 having diameters chosen to enable the swabbing of the casing 56 illustrated in FIG. 2. Sub 84 has a pair of conventional casing scrapers 90 and 92 having diameters chosen to enable the cleaning of the interior wall of casing 56 illustrated in FIGS. 2 and 3. The swab cups 86 and 88, as well as the casing scrapers 90 and 92, are well known in the art and thus require nothing more than a diagrammatic illustration and description. The upper sub 82 (closer to the earth's surface in use) may have a male pin 94 for connection into the drill string 18, whereas the lower sub 84 may have a female lower end 96 for receiving any additional subs below the sub 84, or vice versa.

In the operation of the system in accord with FIGS. 2 and 3, after the potential producing zone 54 has been identified with well logs, core samples, etc., and the steel casing 56 set in the borehole, the drill string 18 having the subs 82 and 84 is prepared for running back into the borehole. At this point in time, the drilling fluid in mud pit 49 has been replaced with completion fluid and is ready to be pumped into the annulus 16 immediately on top of the top surface 87 of swab cup 86. As the drill string 18 is lowered into the borehole, the completion fluid is pumped into the annulus 16 to maintain the annulus above the swab cups full of the completion fluid. As the swab cups 86 and 88 move down in the cased borehole, drilling fluid in the borehole is forced through the open end 96 of the lowermost sub, through a one-way check valve 100, and back towards the earth's surface through the interior fluid channel of the drill string. The check valve 100 prevents the displaced fluid from coming back into the wellbore. Depending upon the volume of the displaced drilling fluid, the drilling fluid can either be pumped back into the mud pit 49 or into a second mud pit (not illustrated) to avoid mixing the returned drilling fluid and the completion fluid at the earth's surface.

By having the casing scrapers 90 and 92 below the swab cups 86 and 88, the casing scraper will remove most, if not all of the buildup on the casing wall which might otherwise destroy or lessen the efficiency of the elastomeric swab cups.

Once the swab cups have been lowered below the portion of the casing 56 covering the planned production zone 54, all of the drilling fluid will have been displaced from the borehole opposite the production zone 54, as by pushing or pulling the fluid being displaced, and the completion, workover or other desired operation through the casing 56 opposite the zone 54 can be accomplished. If the task involves completion, the drill string 18 (or production tubing if desired) can include a conventional perforation sub 100 such as illustrated in FIG. 2, which sub 100 could include bullet guns or shaped charges, all of which is well know in the art as Tubing Conveyed Perforation.

There has thus been illustrated and described methods and apparatus which provide a mechanical separation of the drilling fluid being displaced, from the displacement fluid, typically a completion or workover fluid, thus providing an improvement over the problematic task of pumping three dissimilar fluids through a common fluid channel while attempting to maintain a reasonable separation of the three fluids.

Although the preferred embodiment contemplates using reverse circulation because of being easier to mechanically separate the drilling fluid from the completion or workover fluid, obvious modifications to the preferred embodiment will be apparent to those skilled in the art.

Figure 4:
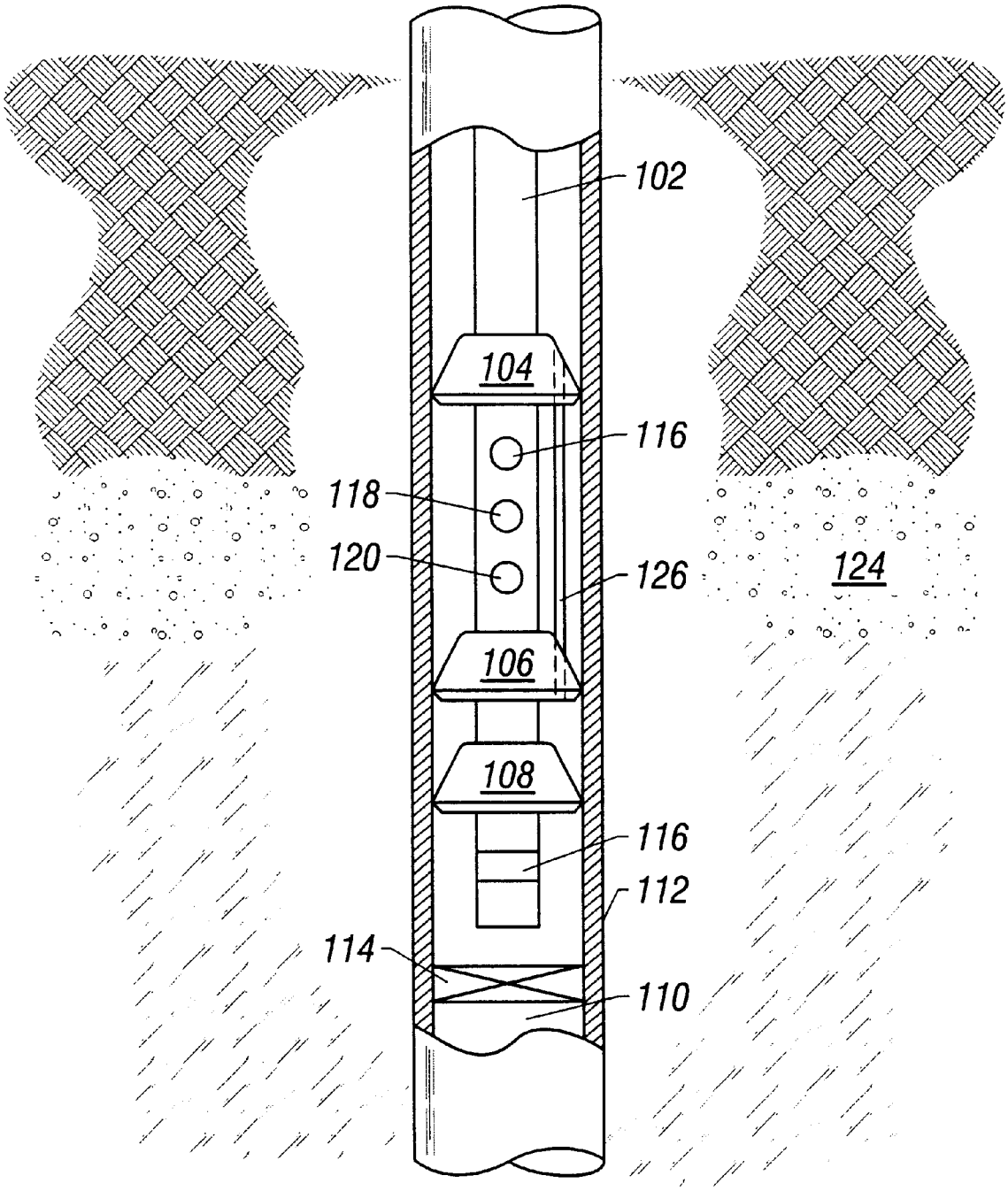
FIG. 4 is an elevated, side, diagrammatic view of the combined well swab and casing scraper used in accordance with an alternative embodiment of the invention.

For example, FIG. 4 illustrates an alternative embodiment of the present invention in which normal circulation is used. The drill string (or other tubular) 102 has a pair of swab cups 104 and 106, as well as a casing scraper 108. The drill string 102 is illustrated as being positioned in an earth borehole 110 into which steel casing 112 has already been run in. A packer 114 is run in as an option to isolate the portion of the borehole 110 above the packer from that portion of the borehole 110 below the packer. The packer 114 can have a surface-controlled fluid bypass if desired to allow drilling fluid to be pumped below the packer as needed. The lower end of the drill string 102 has a plug 116 to prevent the displacement fluid from being pumped out of the lower end of tubular 102 and thus prevents the mixing of the drilling fluid with the completion fluid.

Located intermediate the swab cubs 104 and 106 is at least one orifice 116, but preferably a plurality of orifices 116,118 and 120. One or more fluid conduits 126 are connected between swab cups 104 and to allow drilling fluid within the borehole 110 to bypass the swab cups as the drill string 102 is raised or lowered in the borehole.

In the operation of the apparatus illustrated in FIG. 4, as the drill string 102 is to be lowered into the wellbore 110 from the earth's surface, the interior of the drill string 102 is filled with the completion fluid. The completion fluid also exits the one or more orifices 116, 118 and 120 into the annulus 122 located between the swab cups 104 and 106. The drill string 102 can be lowered or raised to cause the completion fluid to be adjacent the potential producing zone 124 to allow the desired operation to take place, i.e., perforation of the casing 112, workover, etc. If the tubular 102 is production tubing, the casing 112 can be perforated from a perforation gun, or an array of shaped charges carried by the production tubing, all of which is conventional and well known in the art.

For ease of presentation, the displacement fluid has, for the most part, been described herein as being a completion fluid. However, the apparatus and methods described herein are applicable to any downhole system in which one fluid is displacing another, and in which separation of the two fluids is desired. For example, when workover fluids are being used on the formation of interest, it is fairly common to replace the drilling fluid, or whatever other fluid is in the wellbore, e.g., water or hydrocarbons produced from the formation, with such workover fluids. Workover fluids are well known in the art, for example, as described in *Composition and Properties of Oil Well Drilling Fluids*, Fourth Edition, by George R. Gray et al., at pages 476–525. Another fluid which may be used to displace the fluid in the borehole is the so-called packer fluid, also discussed in that same reference on pages 476–525.

Figure 5:
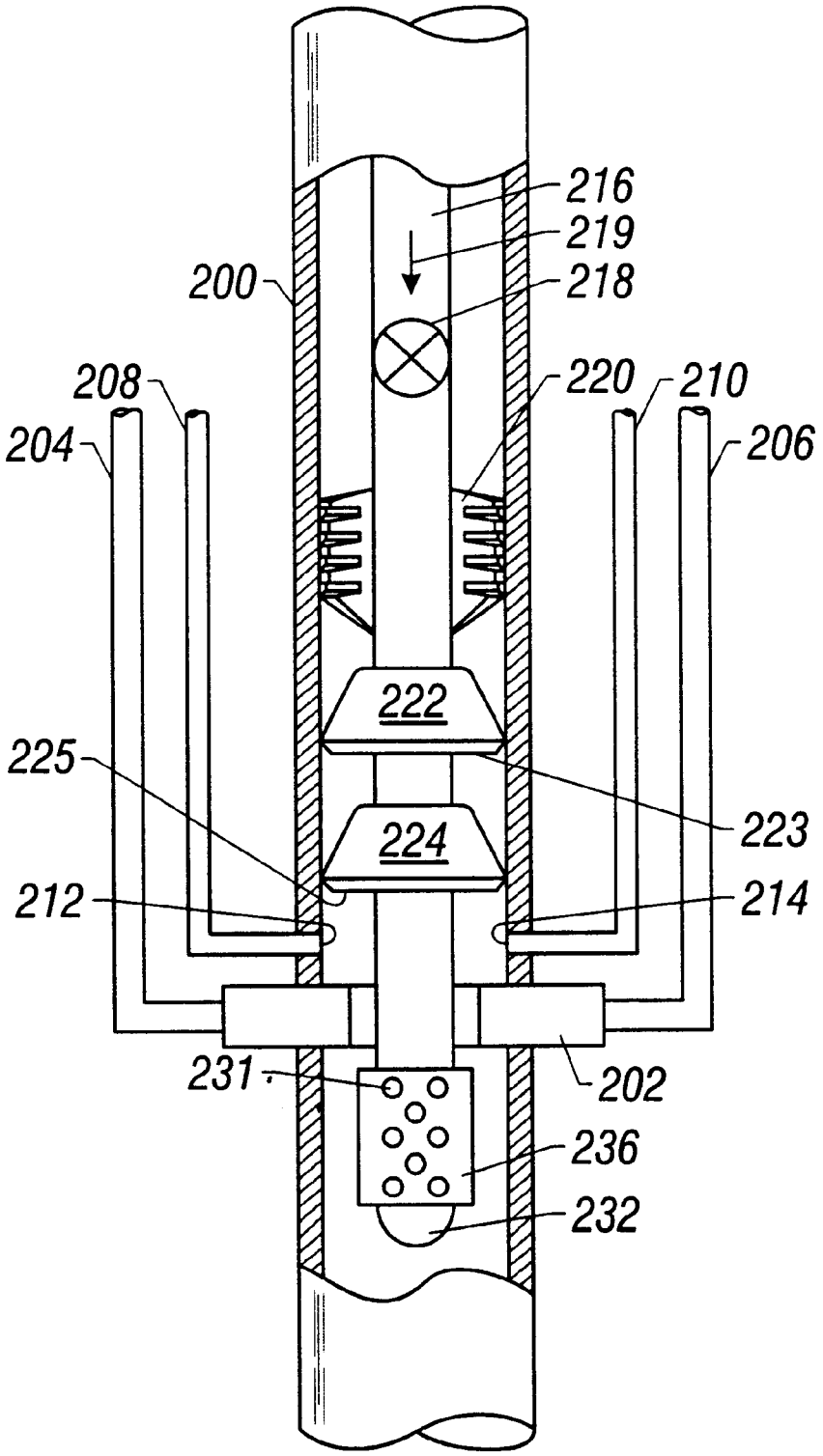
FIG. 5 is an elevated, side, diagrammatic view of the combined swab cup and scraper used in accordance with the invention to clean the interior wall of a drilling or completion riser.

In FIG. 5, a hollow steel riser 200 extending from the earth's surface (not illustrated) or from an offshore platform (not illustrated) used in the drilling, completion, workover and/or production of oil and gas wells, is illustrated as having a blowout preventer 202 (BOP), which typically would be a conventional Ram BOP having one or more hydraulic lines 204 and 206, extending to the earth's surface or to an offshore platform, which are used to open and close its rams. A pair of choke and kill lines 208 and 210 also extend either to the earth's surface or to the offshore platform, as the case may be, and which allow fluid to be pumped into the interior of the riser at inlets 212 and 214, respectively. Although it is common practice to install the choke and kill lines below the BOP, this particular embodiment contemplates the choke and kill lines being installed above the BOP.

A steel tubular 216, for example, a steel drill pipe, is illustrated as run into the interior of the riser 200 from the earth's surface or an offshore platform, and includes a one-way check valve 218 allowing fluid within the tubular 216 to be pumped down through the tubular 216 in the direction shown by arrow 219.

The tubular carries a scraper 220, for example, a steel brush for mechanically cleaning the interior surface of the riser 200, and can be spring-loaded, if desired, to maintain contact with the wall of the riser 200.

The tubular 216 carries one or more swab cups 222 and 224, preferably of the type which are activated by fluid pressure exerted on their lower surfaces 223 and 225, respectively, to engage the interior wall of the riser 200. The swab cups 222 and 224 can be either the type of cups which can be activated, ie., pressed against the interior wall of the riser, by pressure exerted against their lower surfaces, or by pressure exerted against their upper surfaces, viz., by the hydrostatic pressure of the mud column in the riser to be pumped out of the riser, or can be a combination of such swab cups.

The tubular 216 also carries a jetting unit 230 and bull plug 232 at its lower end to allow cleaning fluid to be pumped through the valve 218 and out through the many holes 231 in the jetting unit 230 into the interior of the riser 200.

In the operation of the embodiment of FIG. 5, the tubular 216 is raised enough to cause the jetting unit 230 and bull plug to come out of the open BOP 202. The rams of the BOP are then closed, preventing any fluid from being pumped below the BOP. The choke and kill lines are then activated, putting hydraulic pressure underneath the swab cups 222 and 224. The tubular 216 is thus pumped out of the riser 200 as hydraulic pressure is maintained against the lower surfaces 223 and 225 of swap cups 222 and 224, respectively, preferably while mechanically lifting the tubular 216 from the earth's surface or an offshore platform.

Figure 6:
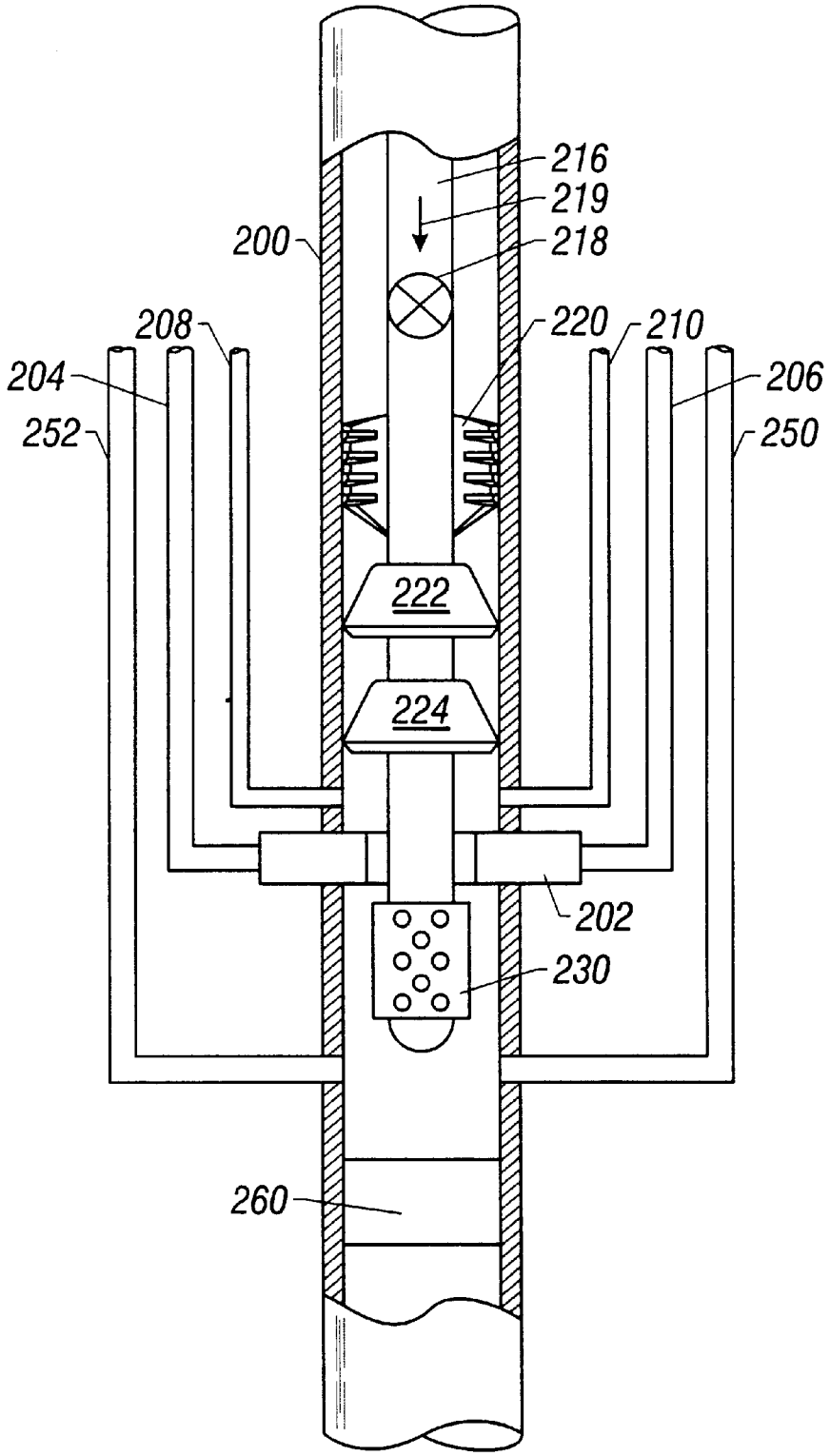
FIG. 6 is an elevated, side, diagrammatic view of the combined swab cup and scraper used in accordance with an alternative embodiment of the invention to clean the interior wall of a drilling or completion riser.

FIG. 6 illustrates an alternative embodiment of the system illustrated in FIG.5, in which the choke and kill lines 250 and 252 are located beneath the BOP 202 and the choke and kill lines 208 and 210 may or may not even be present.

A plug 260, for example, an inflatable packer, is run in and set within the riser 200 below the BOP 202. As soon as the tubular 216 has been lowered to the desired depth in the riser 200, the choke and kill lines 250 and 252 are activated, putting the hydraulic pressure on the lower surfaces 223 and 225 of swab cups 222 and 224, respectively. This causes tubular 216 to be pumped out of the riser 200 as with the embodiment of FIG. 5, but without closing the rams in the BOP 202.

Moreover, whether using the embodiments of FIG. 5 or FIG. 6, one can practice the invention without using the choke and kill lines, merely by either closing the BOP or by setting the plug, and pumping fluid down through the tubular, creating hydraulic pressure against the bottom surfaces of the swab cups.

This is not preferred, however, because this causes the tubular to be pulled while fluid is being pumped through it, sometimes referred to as pulling a "wet string". Those skilled in this art know, however, that by using a "mud bucket" (not illustrated), the wet string problem can be essentially circumvented.

Figure 7:
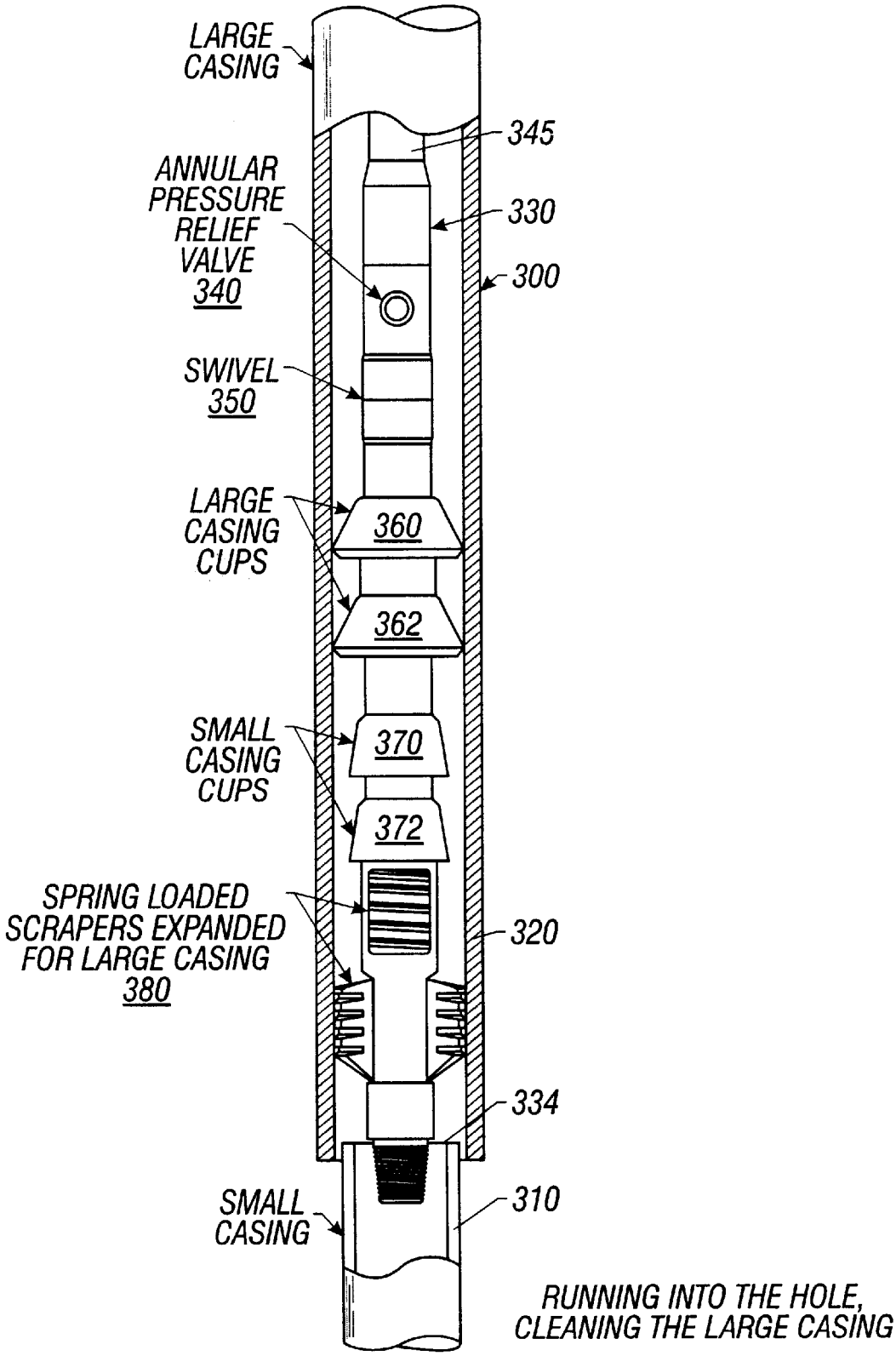
FIG. 7 is an elevated, side, pictorial view, partly in cross-section, of a tool according to the present invention, having spring-loaded casing scrapers and a first pair of swab cups of a given external diameter and a second pair of swab cups of a diameter greater than said given diameter.

Referring now to FIG. 7, there is illustrated a casing string 300 having a lower section 310 of a given internal diameter and an upper section 320 of an internal diameter greater than said given diameter. A tool 330 according to the present invention is run through the interior of the casing string by manipulating a tubular string 345 from the earth's surface, either by lowering or raising the string 345.

The tool 330 includes a conventional annular pressure relief valve 340, a conventional swivel joint 350, a first pair of swab cups 360 and 362, a second pair of swab cups 370 and 372, as well as a plurality of spring-loaded casing scrapers or brushes 380.

The first pair of swab cups 360 and 362 each have an external diameter large enough to swab the internal diameter of the casing section 320. The second pair of swab cups 370 and 372 each have an external diameter large enough to swab the internal diameter of the reduced diameter casing section 310. The plurality of spring-loaded casing scrapers 380 are in their expanded mode to scrape and clean the internal diameter of the casing section 320, but will compress to scrape and clean the internal diameter of the casing section 310, as the tool 330 is lowered into the casing section 310.

Figure 8:
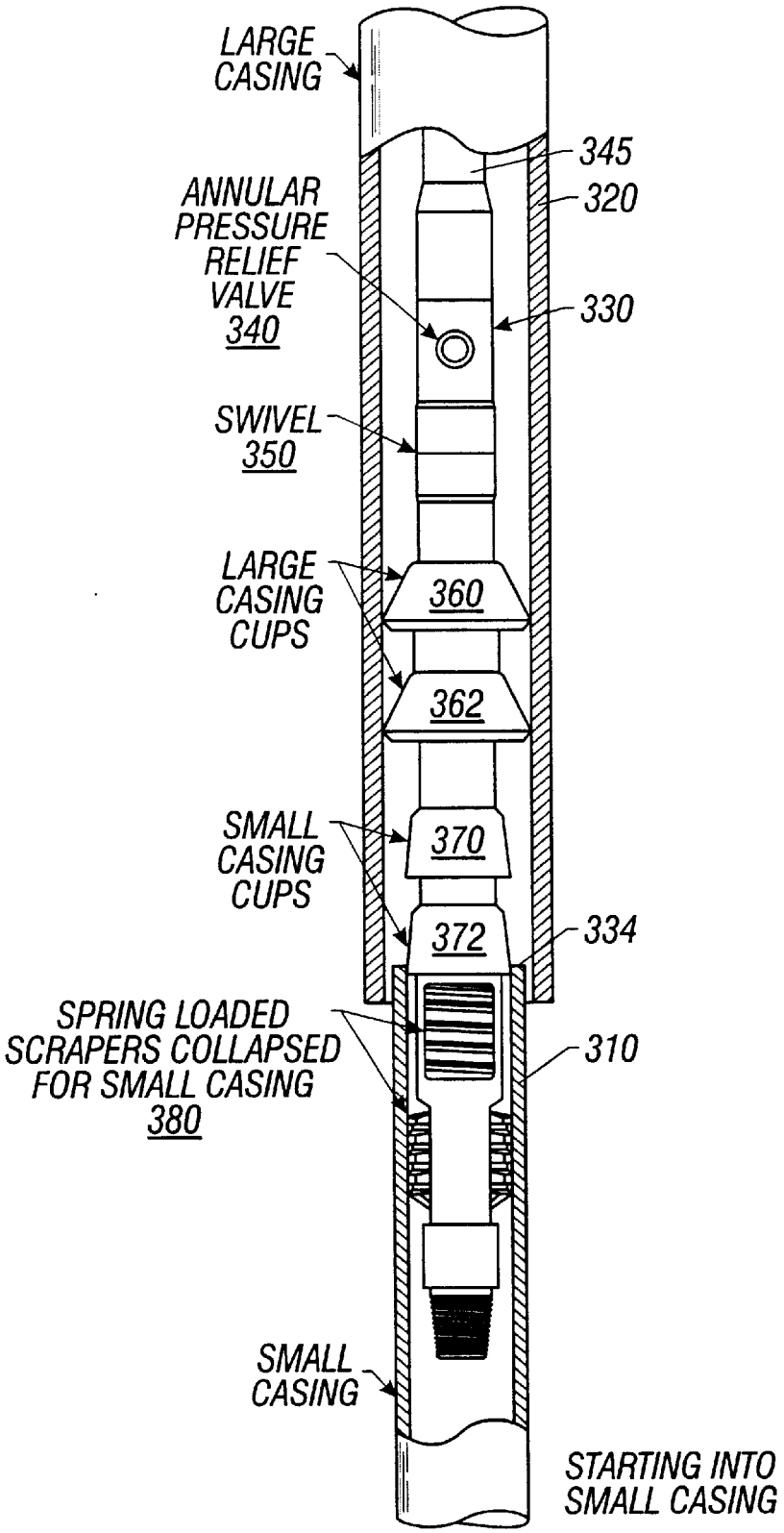
FIG. 8 is an elevated, side, pictorial view of the tool of FIG. 7 as the pair of swab cups of a given diameter are first entering a reduced diameter portion of a casing string.

FIG. 8 illustrates the tool 330 being lowered into the reduced diameter casing section 310 and the compression of the spring-loaded casing scrapers 380 to fit within the reduced diameter casing section 310.

Figure 9:
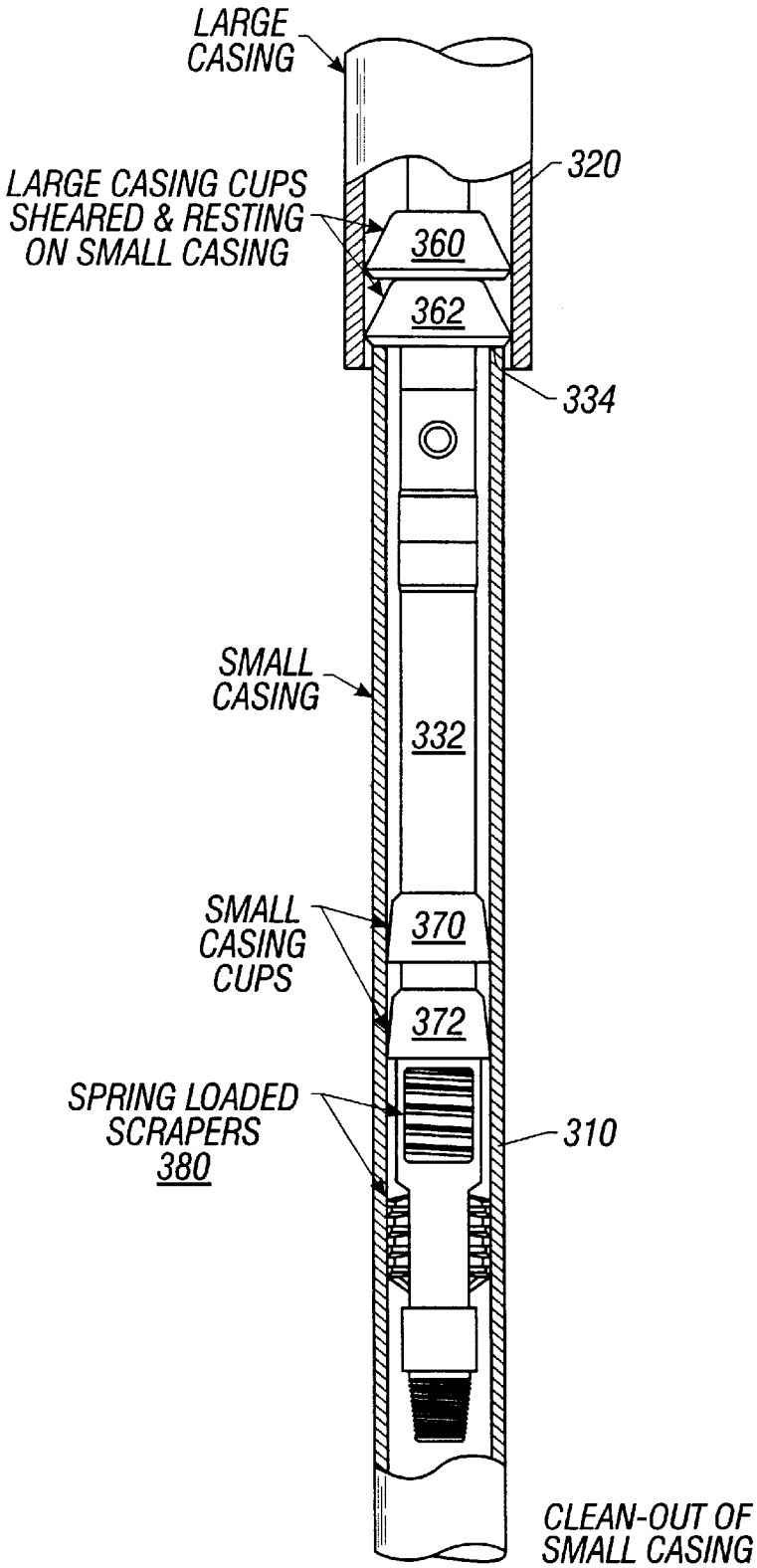
FIG. 9 is an elevated, side, pictorial view of the tool of FIG. 7 illustrating the sheared swab cups of the greater diameter resting on top of the first section of reduced diameter casing.

FIG. 9 illustrates the first, upper pair of swab cups 362 being sheared away from the tubular body or mandrel 332 of the tool 330 upon coming into contact with the upper end 334 of the reduced diameter casing section 310, and resting upon the upper end 334 as the tool 330 is lowered further into the casing section 310.

Figure 11:
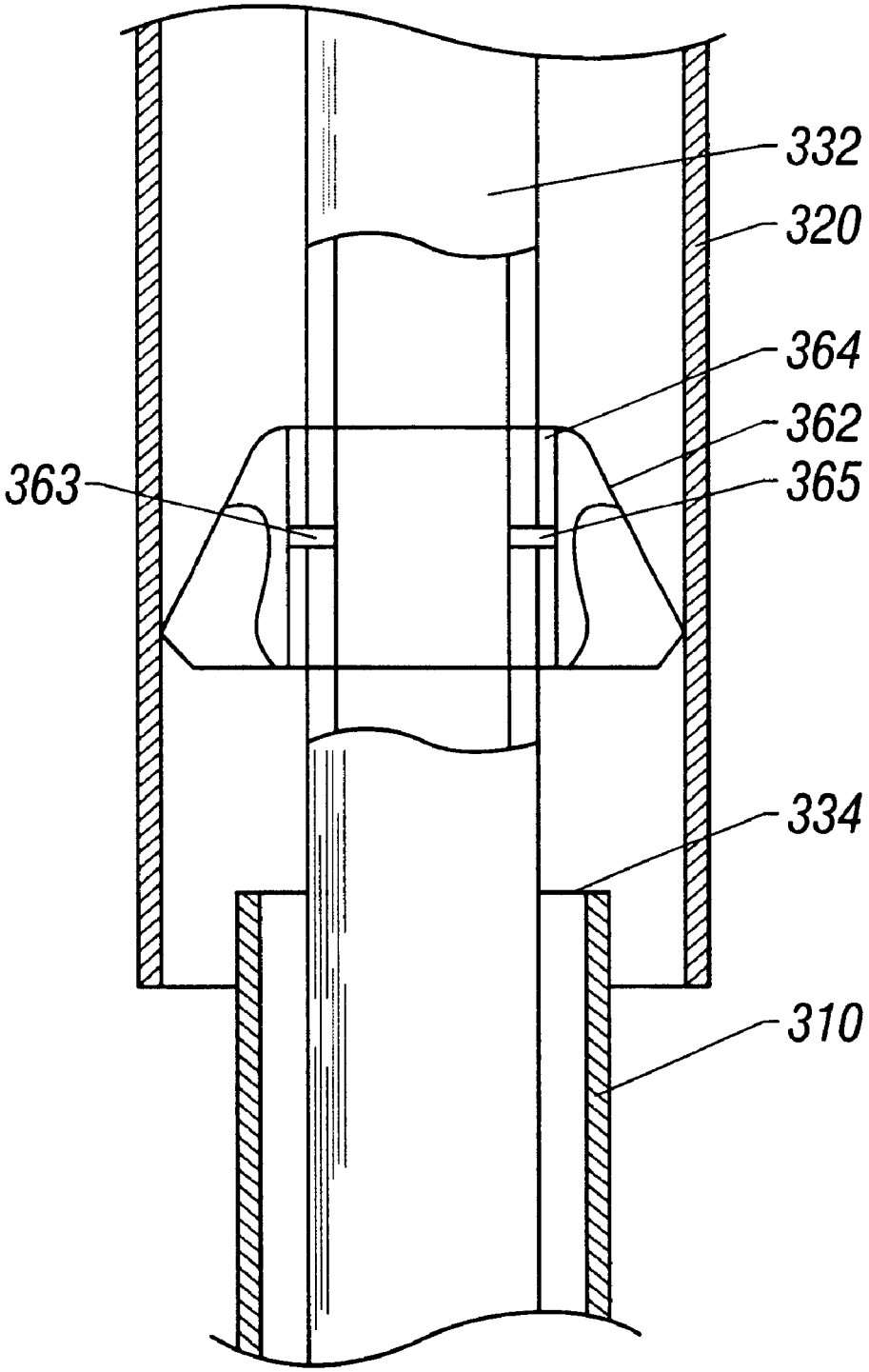
FIG. 11 is an elevated, side, diagrammatic view of a swab cup having a plurality of shear pins designed to allow the swab cup to be sheared away from the mandrel.

FIG. 11 illustrates but one example of how the swab cups 360 and 362 are sheared away from the tubular mandrel 332 of the tool 330. The swab cup 362 has a sleeve 364, preferably manufactured from metal or hard plastic, sized to slide over the exterior surface of the mandrel 332. A plurality of shear pins, illustrated by the pair of shear pins 363 and 365, are used to hold the swab cup 362 secured in place on the mandrel 332. The shear pins are selected to shear at pre-selected values, but should be selected to be of high enough value so as not to shear due to fluid pressure exerted upon the swab cups during the operation of the tool. For example, without limiting the intended use, if the swab cup 362 is expected to be exposed to 1000 psi fluid pressure, the shear pins could be selected to shear at 1500 psi and avoid shearing due to the fluid pressure. Moreover, there may be times in the operation of the apparatus 330 such that the casing scrapers 380, which can be spring-loaded steel brushes if desired, do not clean out the debris properly, and an obstruction can exist in the casing. Such an obstruction could cause a premature shearing of one or more swab cups. A conventional device, commonly referred to as a 'no-go' device, can be mounted on the tool 330 which functions to stop the further lowering of the tool 330 to protect the shearable swab cups, in the event of the "no-go" device encountering such an obstruction.

In the operation of the embodiment of FIG. 11, as the tool 330 is lowered in the casing string until the swab cup 362 comes into contact with the surface 334, the further lowering of the tool 330 causes the shear pins 363 and 365 to shear, as well as the shear pins in swab cup 360 (not illustrated but identical to those used in swab cup 362), causing the swab cups 362 and 360 to rest upon the surface 334 illustrated in FIG. 9. This process allows the smaller swab cups 370 and 372, and the spring-loaded scraper 380 to be further lowered into the smaller casing section 310.

All of the operations described above with respect to FIGS. 1–6 can also be done with the tools illustrated and described in FIGS. 7–11.

Figure 10:
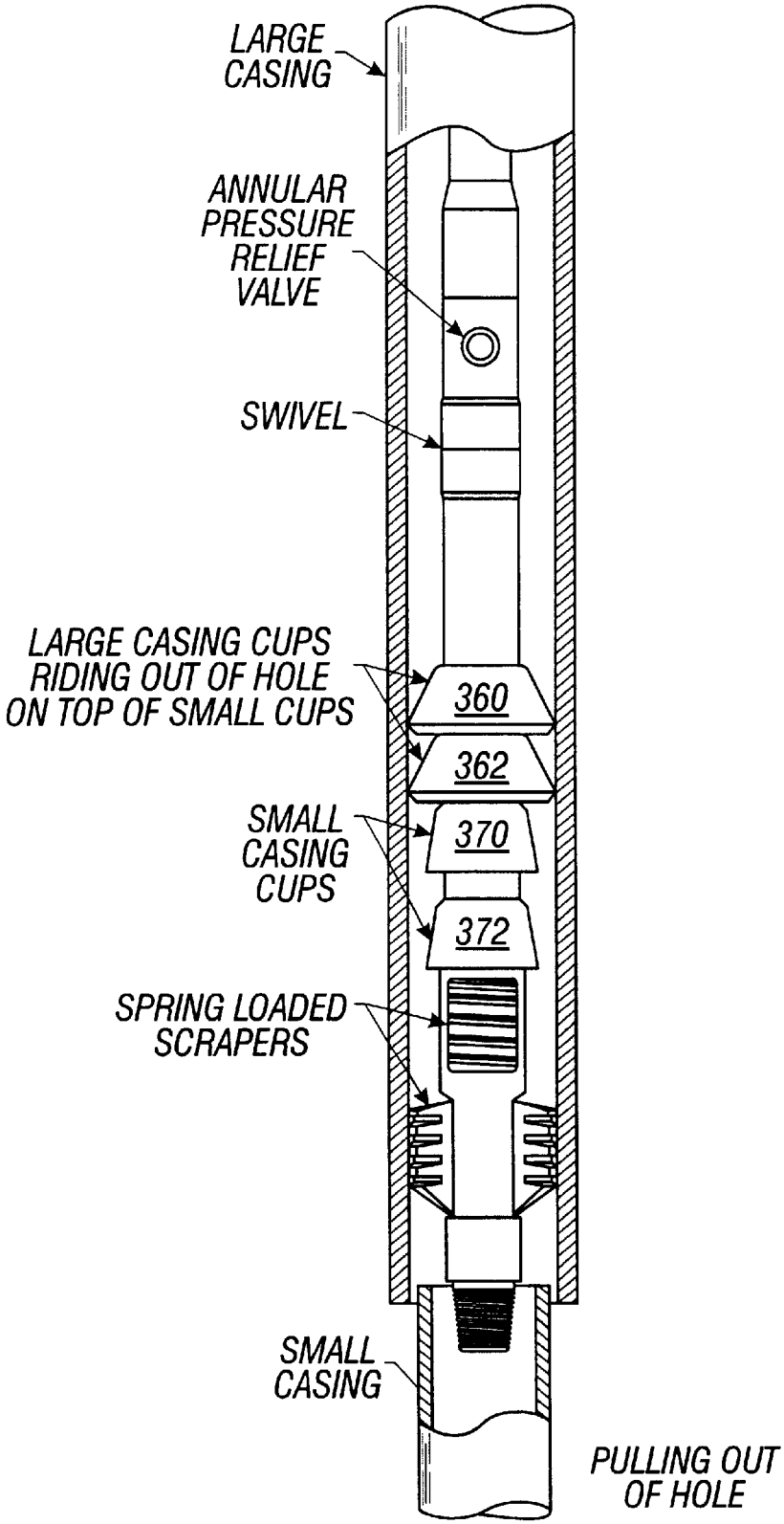
FIG. 10 is an elevated, side, pictorial view of the tool of FIG. 7 illustrating the tool being pulled out of the casing string.

FIG. 10 illustrates the tool 330 being moved up and out of the casing string . If it is desired to move fluid out of the casing, it should be appreciated that the large swab cups 360 and 362 merely rest upon the smaller swab cups 370 and 372, as illustrated in FIG. 10, and as the tubular string 345 is pulled up, the swab cups 360 and 362 push the fluid in the casing all the way up in the casing string to the earth's surface.

While FIGS. 7–11 show the use of a pair of large swab cups and a pair of smaller swab cups in only two sizes of casing, the invention is intended to also be used with three or more different sizes of casing, since the typical oil and gas well is cased progressively smaller with depth in the earth borehole. Although not preferred, the invention contemplates the use of one, two, three or more swab cups of a given size, diameter, or combinations thereof.

There has thus been described herein methods and apparatus for displacing the borehole fluid with another fluid, in selected portions of risers, or of cased earth boreholes. However, it will be understood that changes in the illustrated and described embodiments of the invention will be apparent to those skilled in the art, without departing from the spirit of my invention, the scope of which is set forth in the appended claims.

What is claimed:

1. An apparatus for displacing a first fluid in a cased earth borehole with a second fluid, comprising:

a tubular string of pipe suspended in the cased earth borehole, thereby forming an annulus between said tubular string of pipe and the casing string in said cased earth borehole;

a tubular sub connected within said tubular string of pipe, said sub comprising first and second swab cups mounted on a tubular mandrel having a sidewall and a central fluid passageway through the interior of said mandrel and at least one orifice through the side wall of the mandrel between said first and second swab cups to allow said second fluid to pass from said central fluid passageway to the annulus of said borehole between said first and second swab cups.

2. The apparatus according to claim 1, including in addition thereto, a casing scraper sub connected within said tubular string of pipe below said tubular sub.

3. The apparatus according to claim 1, wherein said tubular string of pipe has an upper end and a lower end, including in addition thereto, a plug in said tubular string below said at least one orifice to prevent said second fluid from being pumped out the lower end of said tubular string.

4. The apparatus according to claim 1, including in addition thereto, at least one fluid bypass conduit located between said first and second swab cups to allow said first fluid to bypass said first and second swab cups as said tubular string of pipe is being raised or lowered within said earth borehole.

5. The apparatus according to claim 1, including in addition thereto, at least one fluid bypass conduit located external to the mandrel between said first and second swab cups.

6. An apparatus for threadable connection within a tubular string of pipe, comprising:

a tubular mandrel having a side wall and a central fluid passageway, said sidewall having an interior surface and an exterior surface, and at least one orifice in the side wall of said mandrel between said fluid passageway and the exterior surface of said mandrel; and first and second swab cups mounted on said mandrel on opposite sides of said orifice.

7. The apparatus according to claim 6, including in addition thereto at least one casing scraper mounted on said mandrel.

8. The apparatus according to claim 6, wherein said tubular string of pipe has an upper end and a lower end, including in addition thereto, a plug in said central fluid passageway to prevent any fluid in said passageway from being pumped out of the lower end of said apparatus.

9. A method for displacing a first fluid in a preselected zone of a cased earth borehole with a second fluid, comprising:

running a string of tubular pipe into said cased earth borehole, thereby forming an annulus between said tubular string of pipe and the casing string in said cased earth borehole;

said string comprising first and second swab cups mounted on a sub incorporated into said borehole surrounding said string of tubular pipe;

pumping from the earth's surface said second fluid into the annulus within said borehole surrounding said string of tubular pipe, and above said first and second swab cups; and lowering said string of tubular pipe in said earth borehole while continuing to pump said second fluid into said annulus from the earth's surface, thereby causing said first fluid in said earth borehole to be pumped through the interior of said string of tubular pipe towards the earth's surface, until said first and second swab cups have traveled past the preselected zone of said cased earth borehole.

10. The method according to claim 9, including in addition thereto, the step of scraping the casing ahead of said swab cups swabbing such casing.

11. The method according to claim 9, wherein said first fluid is a drilling fluid and said second fluid is a completion fluid selected from the class of calcium chloride, calcium bromide, zinc bromide or mixtures thereof.

12. The method according to claim 9, wherein said second fluid is a workover fluid.

13. A method for displacing a first fluid in a preselected zone of a cased earth borehole with a second fluid, comprising:

running a string of tubular pipe into said earth borehole, said string comprising first and second swab cups mounted on a sub incorporated into said string of tubular pipe;

pumping from the earth's surface said second fluid through the interior of said string of tubular pipe and into the borehole annulus exterior to said string of tubular pipe between said first and second swab cups; and lowering or raising said string of tubular pipe, thereby displacing said first fluid adjacent to said preselected zone of said cased earth borehole, until the second fluid is adjacent the preselected zone of said cased earth borehole.

14. The method according to claim 13, wherein said first fluid is a drilling fluid and said second fluid is a completion fluid selected from the class of calcium chloride, calcium bromide, zinc bromide or mixtures thereof.

15. The method according to claim 13, wherein said second fluid is a workover fluid.

16. An apparatus for cleaning a tubular string in an earth borehole comprising a first tubular section having an internal surface of a given internal diameter; and a second tubular section having an internal surface of an internal diameter smaller than said given diameter, one end of said first tubular section being connected to one end of said second tubular section, the apparatus comprising:

an elongated tubular body sized to pass through said first and second tubular sections;

a first swab cup shearably secured to said tubular body, and being sized to swab the internal surface of said first tubular section;

a second swab cup secured to said tubular body, and being sized to swab the internal surface of said second tubular section; and a spring-loaded casing scraper mounted on the tubular body sized to pass through and scrape the internal surfaces of said first and second tubular sections.

17. The apparatus according to claim 16, wherein said second swab cup is shearably secured to said tubular body.

18. An apparatus for cleaning a tubular string in an earth borehole comprising a first tubular section having an internal surface of a given internal diameter; and a second tubular section having an internal surface of an internal diameter smaller than said given diameter, one end of said first tubular section being connected to one end of said second tubular section, the apparatus comprising:

an elongated tubular body sized to pass through said first and second tubular sections;

at least two swab cups shearably secured to said tubular body, and being sized to swab the internal surface of said first tubular section;

at least two additional swab cups secured to said tubular body, and being sized to swab the internal surface of said second tubular section; and a spring-loaded casing scraper mounted on the tubular body sized to pass through and scrape the internal surfaces of said first and second tubular sections.

19. The apparatus according to claim 18, wherein said additional swab cups are shearably secured to said tubular body.

* * * * *